United States Patent [19]

Pepe

[11] 4,285,668

[45] Aug. 25, 1981

[54] PRESSURIZED GAS SEAL FOR FURNACE ATMOSPHERE CONTAINMENT

[76] Inventor: Robert D. Pepe, 132 Fremont St., Lowell, Mass. 01850

[21] Appl. No.: 81,279

[22] Filed: Oct. 3, 1979

[51] Int. Cl.[3] ..... F27D 7/00; F27D 1/18; F26B 25/00

[52] U.S. Cl. ..... 432/19; 34/242; 432/242

[58] Field of Search ..... 432/8, 242, 19; 34/242

[56] References Cited

U.S. PATENT DOCUMENTS

| | | | |
|---|---|---|---|
| 2,253,897 | 8/1941 | Doderer | 432/242 |
| 3,467,366 | 9/1969 | Westeren et al. | 432/242 |
| 3,606,288 | 9/1971 | Bloom | 432/242 |
| 3,952,568 | 4/1976 | Wareing et al. | 432/242 |

*Primary Examiner*—John J. Camby

*Attorney, Agent, or Firm*—Pearson & Pearson

[57] ABSTRACT

The opposite ends of a conveyor tunnel furnace are free of physical seals and instead each end is provided with a gas seal tunnel. Each gas seal tunnel is formed by at least two spaced apart, transversely extending fluid flow restriction members defining at least one gas seal chamber therebetween. Gas is supplied in a fixed volumetric flow to each gas seal chamber and maintained at a pressure greater than that of the furnace or of the ambient atmosphere. The flow restriction members are adjustable to cause accelerated gas flow therethrough, or therearound, to prevent mixing or diffusion of gases.

6 Claims, 7 Drawing Figures

PRESSURIZED GAS SEAL FOR FURNACE ATMOSPHERE CONTAINMENT

BACKGROUND OF THE INVENTION

The sealing of the ends of the heat treatment tunnels of conveyor tunnel furnaces has long presented a problem. This is especially true of furnaces whose chambers, or tunnels, must be constructed air tight for reasons of atmospheric oxidation prevention, partial pressure control of (explosive) gases or toxic gas containment.

Each of these applications requires atmospheric isolation yet the material being processed, whether it be continuous in the form of strips and/or wire, or bulk products riding on a conveyor belt or push boats, must have access to and from the furnace chamber. The means of access to and from the chamber ideally prevents any gases from crossing the boundary of the heating chamber of the furnace, while allowing the product to be treated to do so as easily as possible.

It has heretofore been proposed to provide access to the heating chamber through mechanical, or physical type seals.

Exemplary of such seals are the felt pad graphite block seals at each opposite end of the furnace in U.S. Pat. No. 2,057,518 of Oct. 13, 1936 to Fraser. A non-aqueous liquid seal using oil as the sealant is also disclosed in this patent. In U.S. Pat. No. 3,169,157 to Harris of Feb. 9, 1965 liquid sealing means in the form of opposed sponge pads saturated with water is disclosed.

U.S. Pat. No. 3,396,951 of Aug. 13, 1968 to Cope, reissued as No. Re: 28,168 of Sept. 24, 1974, not only discloses upper and lower nip rolls for sealing the furnace against admission of air, but also discloses a gate slidable over an opening in a wall for maintaining pressure and the immersion of a treated wire in a molten zinc bath at the end of the treatment zone.

Single pivoted gates, like single slidable gates are also old in the art as exemplified in U.S. Pat. No. 2,942,742 to Wilbur of June 28, 1960 wherein single gates between chambers are automatically actuated by limit switches which are engaged by trays on the conveyor.

Single article actuated entrance and exit radiation shield gates or doors are disclosed in U.S. Pat. No. 3,130,250 to Mescher of Apr. 21, 1964.

Pressurized sealing tunnels having multiple, article-actuated, gates, or flaps, to maintain a seal pressure less than furnace pressure, or to retain furnace gas are disclosed in U.S. Pat. No. 2,253,897 to Doderer of Aug. 26, 1941, U.S. Pat. No. 3,467,366 to Westeren, et al, of Sept. 26, 1969 and U.S. Pat. No. 3,606,288 to Bloom of Sept. 20, 1971.

However, such seals are gas retarders and not positive, fully effective gas seals making it impossible for expensive treatment gas to leak out or damaging air to leak into the furnace.

SUMMARY OF THE INVENTION

It is the object of this invention to provide atmospheric chamber sealing by the use of pressurized gas seals, all sealing being provided by the seal gas and no physical structure such as liquids, pads, sponges, or nip rolls needing to come into contact with the material or articles being processed.

This is accomplished by providing a pair of sealing tunnels, each at an opposite end of the heat treatment tunnel of a conveyor tunnel furnace, and each having a pair of spaced apart, transversely extending fluid flow restriction members defining a gas seal chamber therebetween. The pair of transverse members may be formed by the spaced apart end walls of the tunnel, each having a gas seal opening closed by an adjustable sliding gate. They may also be formed by at least three weighted gates pivoted between the open ends of the gas seal tunnel, to form at least two gas seal chambers and mounted to individually and successively pivot out of the path of articles advancing by one of several conveyor means. Each gate returns to its equilibrium position, once the conveyed article passes, by gravity.

An inlet gas manifold, or port, is provided in each gas seal chamber connected to a source of gas such as nitrogen under predetermined pressure to deliver the required volumetric flow so that the gas pressure in the gas seal chamber is maintained slightly higher than the ambient atmospheric pressure and slightly higher than the gas pressure in the heating tunnel of the furnace. These pressure differences produce an accelerated gas flow through the flow restrictors. Thus, no air can enter the furnace to adversely affect the material being treated therein and no toxic gases can leak out of the furnace.

An exhaust gas manifold, or port is also provided in each gas seal chamber. When connected to a source of negative gas pressure such as plant suction, a second mode of operation is obtained. Here the gas seal chamber is maintained at pressure slightly lower than the ambient atmosphere and the gas pressure in the heating tunnel of the furnace. As before, these pressure differences produce the accelerated gas flow through the flow restrictors establishing a "gas lock".

DESCRIPTION OF THE PREFERRED EMBODIMENTS

Figure 1:
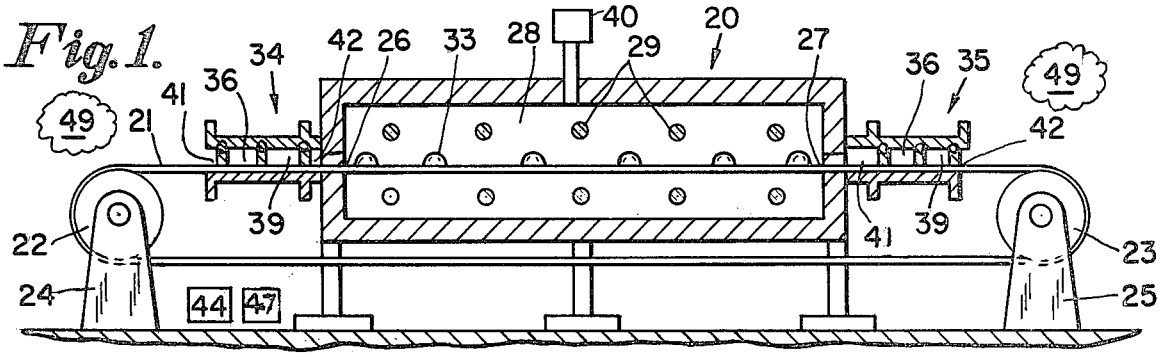
FIG. 1 is a diagramatic side elevation of a typical conveyor tunnel furnace with a pressurized gas seal of the invention at the entrance end and at the exit end.
Figure 6:
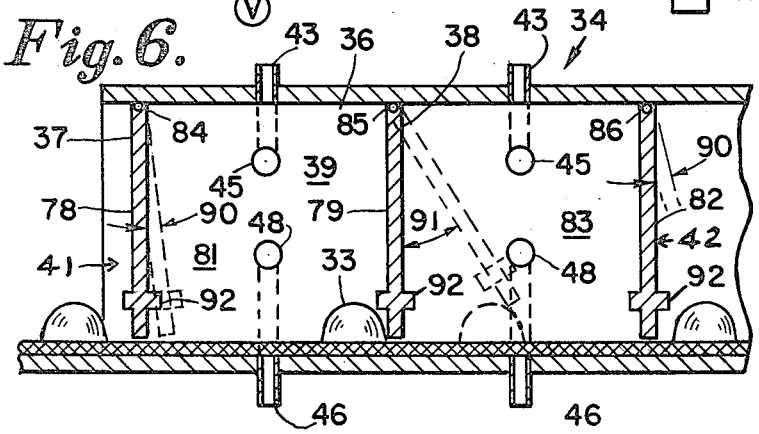
FIG. 6 is a view similar to FIG. 2 and FIG. 4 of the pressurized gas seal of the invention for use with bulk products on a conveyor belt.
Figure 7:
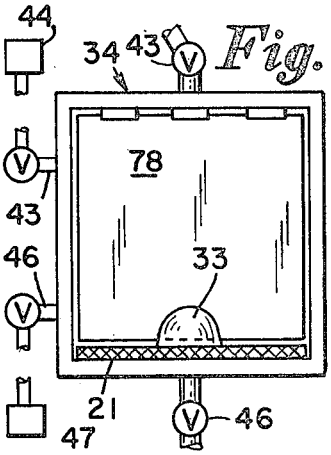
FIG. 7 is a front elevation of the seal of FIG. 6.

As shown diagramatically in the drawing, a typical conveyor tunnel furnace 20 includes an endless conveyor belt 21, trained around the rolls 22 and 23 which are rotatable in roll stands 24 or 25, one roll being driven by suitable means not shown and well known in the art. The furnace 20 includes the entry end opening 26, exit end opening 27, heating, or treatment, tunnel 28 and heating, or treating elements 29, all well known in the art. The elongated heating tunnel, or chamber, is air tight to prevent oxidation of the material being treated which may be wire 31, of circular cross-section (FIGS. 2 and 3), web or strip material 32 of rectangular cross-section (FIGS. 4 and 5) or may be bulk products 33 carried on a conveyor belt 21, or in pusher boats (FIGS. 1, 6 and 7).

First pressurized gas seal means 34 is affixed at the entry end opening 26 and second pressurized gas seal means 35 is affixed at the exit end opening 27 of the elongated heating tunnel 28 of furnace 20. Means 34 and 35 are identical so that a description of one will serve as a description of the other. Each pressurized gas seal means 34 or 35 includes a gas seal tunnel 36, through which the material to be treated in furnace 20 may pass, and at all times, at least one pair of spaced apart fluid flow restriction members 37 and 38 extending transversely thereof and defining a gas seal chamber 39 therebetween. Each gas seal tunnel 36 includes a gas seal end opening 41 at the entry end and a gas seal end opening 42 at the exit end thereof.

On either side of the gas seal chamber 39 of each pressurized gas seal of the invention, there is an outside chamber and an inside chamber. When the pressurized gas seal is utilized as an entrance seal to a furnace 20, the outside chamber is the ambient room atmosphere, while the inside chamber is the chamber, or tunnel 28 of the furnace which is maintained at positive gas pressure by first gas pressure supply means 40.

Each gas seal is provided with an inlet gas manifold 43 connected to a second gas pressure supply means 44, supplying gas such as nitrogen at a predetermined pressure to provide the required volumetric flow of gas to the gas inlet port 45.

In an alternate mode of operation, each gas seal is provided with an exhaust gas manifold 46 connected to a supply of negative pressure 47, such as mill suction and arranged to exhaust gas seal chamber 39 through exhaust port 48.

Figure 2:
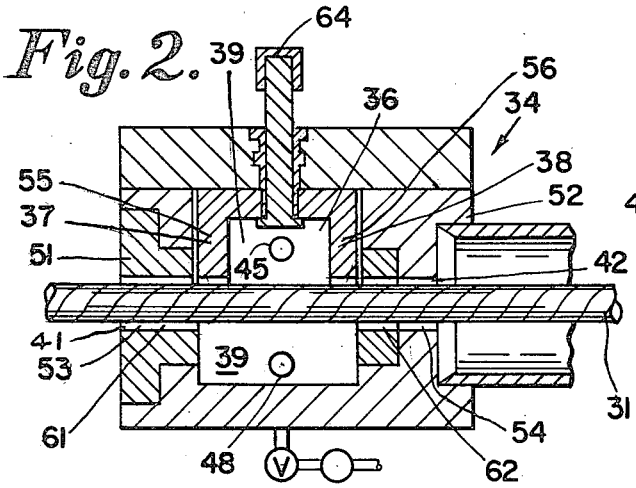
FIG. 2 is a fragmentary, enlarged side elevation in half-section of an embodiment of the pressurized gas seal of the invention for use with wire material.
Figure 3:
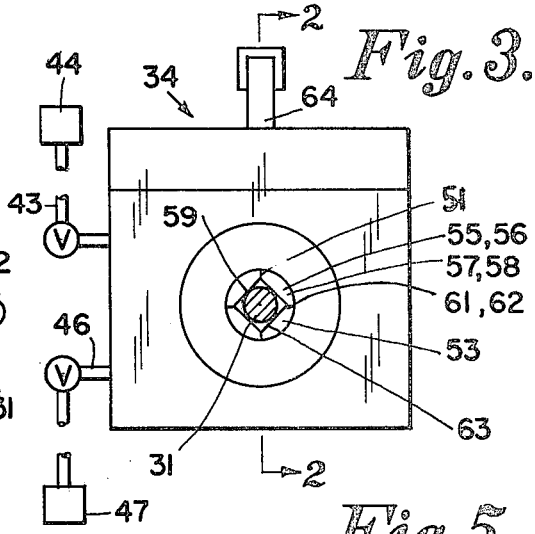
FIG. 3 is a front elevation of the seal of FIG. 2.

In FIGS. 2 and 3 the gas seal chamber 39 is provided with a volumetric flow of seal gas through the inlet gas port 45 and inlet gas manifold 43 from the supply 44. The flow of seal gas is adjusted to maintain a positive pressure in the gas seal chamber 39 which is slightly greater than the gas pressure in chamber 28 of furnace 20 and greater than the ambient atmospheric pressure in the area 49 outside the furnace 20. The seal gas used is inert for most applications. However, some applications such as toxic gas containment permit air to be used and other applications even allow the process gas to be introduced here. Elevated temperature operation of the gas seal means 34 or 35 enhances the performance by making use of the seal gas in its expanded state. Operational costs are reduced by the reduction of the required mass flow rate of the seal gas for any given volumetric flow in the gas seal.

The embodiments of FIGS. 2, 3, 4 and 5 are designed around the geometry of the wire 31 and the web 32. In FIGS. 2 and 3, a continuous wire 31 of symetrical cross section, such as circular, is shown as it would be advanced for treatment through the furnace 20 in place of the endless conveyor belt 21 shown in FIG. 1. In this embodiment the pair of spaced-apart, transversely-extending, flow restriction members 37 and 38 are formed by end walls 51 and 52 of tunnel 36, each having a seal end opening 53 or 54 therein and a pair of adjustable gates 55 and 56 each mounted to slide across one of the openings 53 or 54. Each gate 55 or 56 includes a notch 57 or 58, in the lower edge 59 and each opening includes a complementary notch 61 or 62 in the upper edge 63 which jointly encompass the advancing wire, without making contact, to seal the openings 53 and 54 against leakage of gas therethrough. Each notch may be of semi-circular cross section to fit around wire of uniform circular cross section, or, if wires of different diameters are to be run, the notches may be right angular to form polygonal openings of the desired cross sectional area, as shown, without undue leakage. Preferably the gates 55 and 56 are slidably adjustable by the common central rod 64 from outside the tunnel 36 to permit raising and lowering of the gates to adjust the seal end openings to the required clearance. This flow area reduction causes the seal gas to accelerate to a high velocity at the seal gates 55 and 56. This high velocity helps to prevent contamination by back diffusion of process atmospheres. The height of the adjustable gates 55 and 56 and the cross sectional area of the wire or web material 31 or 32 determines the volumetric flow required to produce the required gas pressure in chamber 39 in the pressurized gas seals. The seal chamber pressure, when adjusted to be greater than the ambient atmosphere pressure at 49 and greater than the gas pressure in chamber 28 of furnace 20, is a "gas lock" which prevents any of the outside or inside chamber gases from mixing.

Figure 4:
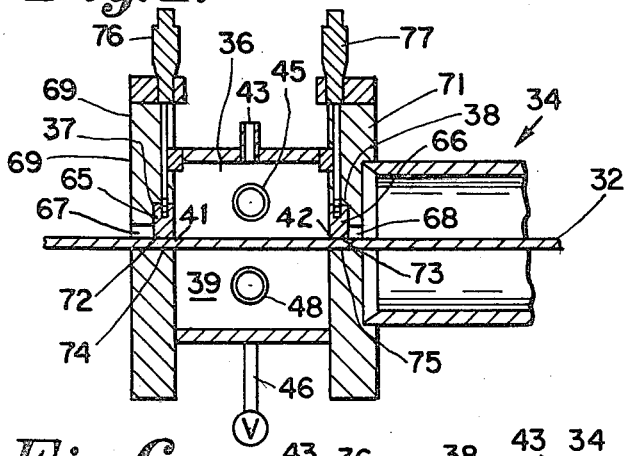
FIG. 4 is a view similar to FIG. 2 of the pressurized gas seal of the invention for use with web, or strip, material.
Figure 5:
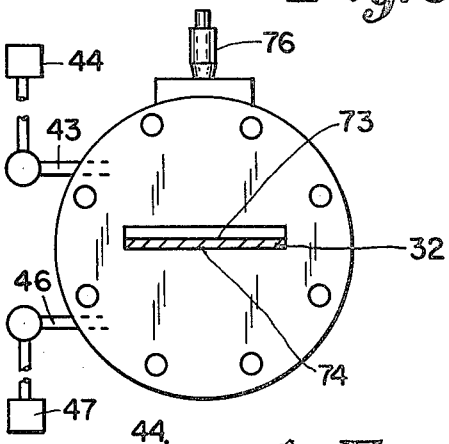
FIG. 5 is a front elevation of the seal of FIG. 4.

In FIGS. 4 and 5 the material to be processed is a web, or strip, 32, and a pair of slidable, adjustable gates 65 and 66 similar to slidable, adjustable gates 55 and 56 are mounted to slide across the gas seal openings 67 and 68 in the tunnel end walls 69 and 71, thereby constituting the spaced apart, transversely extending flow restriction members 37 and 38.

The lower edges 72 and 73 of gates 65 and 66 are flat and planar and the upper edges 74 and 75 of gas seal openings 67 and 68 are also flat and planar so that an opening of rectangular configuration is formed which closely fits the rectangular cross section of the web, or strip, 32. Instead of a common control rod 64, each gate 65 and 66 has an individual control rod 76 or 77 by which the desired clearance may be obtained.

The exhaust gas manifolds 46 provide a means of removing any contaminants that back diffuse into the seal chamber. By providing suction to these manifolds the seal chamber may be purged of all contaminants. These exhaust gas manifolds 46 also provide a second mode of operation of the seals. By closing the inlet gas manifolds 43 and providing a large amount of suction to the exhaust gas manifold 46 the previously defined gas flow pattern reverses. A high velocity stream of inside and outside chamber gases flows into the seal chamber 39 and out the exhaust manifold 46. By balancing the volumetric flows of the inside/outside chamber gases and providing sufficient suction, any cross contamination is avoided. When operated in this mode, the costly introduction of seal gas is eliminated. The seal operates on the inside/outside chamber gases with the major function of the gas seals being one of balancing the flows. Of course, for the case of toxic or flammable process gases, suitable burning of these gases after the seal suction is required.

Strips and wires are geometrical. The requirement of reducing the flow area around the processed part is easily obtainable. However, for bulk products such as sintered parts, brazed aircraft parts, printed circuit boards and steel heat treated machine parts, fitted openings are not always possible. FIGS. 1, 6 and 7 show a tandem weighted gate pressure seal. This seal provides a tunnel opening, usually rectangular, in through which the bulk products may pass. A minimum of two chambers in tandem is required. This corresponds to three weighted gates. The number of tandem chambers is countless with the overall pressure differential increasing with the number of individual chambers.

In this embodiment the spaced apart, transversely extending flow restriction members 37 and 38 are formed by any two of three weighted gates 78, 79 and 82, with a gas seal chamber 81 or 83 therebetween. The gates are so spaced apart that two gates are always depending downwardly from their pivots, 84, 85 and 86, by the force of gravity. When the conveyed product raises one gate 79, to the angle shown at 91, the remaining two gates form the gas seal chamber.

Each chamber 81 and 83 of the pressurized tandem gas seal operates identically to the seals of FIGS. 2 to 5. Each chamber is provided with an inlet gas manifold 43 and an exhaust gas manifold 46. Each chamber has a pair of entrance/exit gates 78 and 79, or 79 and 82 pivoted on low friction pins on pivots 84, 85 or 86. These gates are weighted as at 92 so that pressure differentials of two adjacent chambers cause only small equilibrium gate pivot angles. The weights 92 determine the pressure rating of the chamber 81 and 83. The gates are sized to the tunnel shape reducing the flow area. The bottom flow area, based on the equilibrium gate pivot angle shown at 90 determines the required volumetric flow corresponding to the required chamber pressure. The side and top flow areas are independent of pivot angle. As discussed above, the reduced flow area, produces high velocity flow at the top/bottom and sides of the gates, helping to reduce back diffusion of process atmospheres. Each gate is weighted at 92 as required to maintain equilibrium gate pivot angle within the allowable tolerance range of the flow area. As the equilibrium gate pivot angle 90 increases, the chamber pressure reduces sharply for fixed volumetric flow rates. In a tandem series of chambers, each gate is weighted at 92 successively higher to allow progressively higher chamber pressures.

When each chamber is operating at its equilibrium pivot angles 90, the operation mode of the seal is as discussed with the strip and wire seals. However, as the bulk product or wire basket is propelled through the seal by the conveyor mechanism 21, the gates must open to a very large pivot angle such as at 91. (Note that the gates are opened by the conveyed product. If the conveyed material is too "delicate" or light to lift the gates, the processed material is placed into a heavy rigid wire basket). At very large pivot angles, the gate is ineffective and in effect, the two adjacent chambers act as one large chamber. It is important that the conveyor product spacing be greater than two seal chamber lengths so that only one gate is lifted at a time in any two adjacent chambers. If product spacing is not considered, it is possible that all gates will be open simultaneously, providing direct mixing of inside/outside chamber atmospheres. Since one gate will open at a time, a 2 chamber, 3 gate pressure seal is the minimum size. With one gate open, the two remaining gates determine the pressure chamber. As in the other embodiments, each chamber is provided with an inlet and exhaust gas manifold. Suction provided to the exhaust manifold will remove any contamination introduced when opening the gates to the inside/outside chamber atmospheres. As with the strip and wire seals, the tandem weighted gate pressure seal of FIGS. 1, 6 and 7 may operate under the suction mode.

Since some conveyor furnaces require long process times over short distances, slow belt speeds are common. With slow belt speeds, the requirement of bulk product spacing greater than two seal chamber lengths become inefficient and costly. The furnace hot zone is only being partially utilized. The problem is somewhat allevidated if tight packing becomes thermal load limiting. If tight packing is required, the load and unload tables of the furnace should be run at linear speeds greater than the process linear speed by the ratio of product spacing to product length.

In the method of the invention the first and second pressurized gas seals, each at an opposite end of the elongated, gas pressurized, heat treatment furnace are each formed by at least two slidable gates, forming at least one gas seal chamber therebetween, or by at least three pivoted gates, forming at least two gas seal chambers therebetween. A predetermined volumetric flow of sealing gas is supplied to each gas chamber and maintained at a pressure greater than the pressure of the gas in the treatment tunnel and greater than ambient atmospheric pressure to form a "gas lock" preventing leakage of gas into or out of the treatment tunnel.

The step of establishing and maintaining the predetermined pressure in each gas seal chamber is accomplished by providing sufficient volumetric flow to the gas seal chamber while maintaining flow restriction at each opposite end of each gas seal chamber, or tunnel, that is greater than the pressure of gas in the furnace and greater than ambient atmospheric pressure. The slideable gates are adjusted as to clearance and the pivotable gates are adjusted as to weight so that the difference in ambient pressure, gas seal chamber pressure and furnace pressure causes accelerated flow through, and at, the flow restrictions formed by the gates to prevent mixing or diffusion of gases.

This invention is not limited in its application and details of construction described and illustrated herein. The invention may be utilized on equipment other than furnaces. Applications such as refrigeration and conveyor paint spraying are examples of other applications. It should also be noted that these seals may be utilized between different furnace chambers and/or zones.

I claim:

1. The method of sealing the pressurized gas in a heat treatment tunnel aganst the introduction of air thereinto, or the escape of gas therefrom, by means of a gas seal at each opposite end of the tunnel, each gas seal formed by at least two flow restrictive gates, spaced apart to form at least one gas seal chamber therebetween which comprises the steps of:

establishing and maintaining a predetermined volumetric flow of sealing gas in each said gas chamber at a pressure greater than the pressure of gas in said heat treatment tunnel and greater than ambient atmospheric pressure;

and adjusting said gates so that the difference in pressure in said atmosphere, sealing chamber and tunnel causes accelerated flow through the flow restrictive gates to prevent mixing or diffusion of gases.

2. A method as specified in claim 1 wherein:

the step of adjusting said gates is performed by sliding said gates open or closed from outside said gas seals.

3. A method as specified in claim 1 wherein:

the step of adjusting said gates is performed by pivoting said gates into closed position under the gravitational influence of selected weights.

4. A gas seal for the inlet, or outlet, of a heat treatment tunnel operating at a predetermined gas pressure, said gas seal being of the type having at least two flow restrictive gates spaced apart to form at least one gas seal chamber therebetween and characterized by:

means for establishing and maintaining a predetermined volumetric flow of sealing gas into said gas seal chamber at a pressure which is greater than the gas pressure in said heat treatment tunnel and greater than ambient atmospheric pressure;

and means for adjusting the clearance openings of said gates so that the pressure differences in said tunnel, chamber and atmosphere produce accelerated gas flow through said gate openings and establish a gas lock in said chamber.

5. A gas seal as specified in claim 4 wherein:

said flow restrictive gates are mounted to slide open and closed; and said means for adjusting the clearance openings of said gates is at least one control rod connected thereto and extending outside said gas seal to permit adjusting during operation from outside said gas seal.

6. A gas seal as specified in claim 4 wherein:

said flow restrictive gates are mounted to pivot individually and successively open and closed by actuation of articles passing through said gas seal; and said means for adjusting the clearance openings of said pivoted gates comprises at least three said gates forming at least two said chambers and weights on said gates selected to return each gate to equilibrium position by the force of gravity and chamber gas pressure once each article has passed through said gate.

* * * * *